US009862074B2

(12) United States Patent
Wang

(10) Patent No.: US 9,862,074 B2
(45) Date of Patent: Jan. 9, 2018

(54) WRENCH WITH TRANSLATIONAL WRENCH JAW

(71) Applicants: HANGZHOU GREAT STAR TOOLS CO., LTD., Zhejiang (CN); HANGZHOU GREAT STAR INDUSTRIAL CO., LTD., Zhejiang (CN)

(72) Inventor: Min Wang, Hangzhou (CN)

(73) Assignees: HANGZHOU GREAT STAR TOOLS CO., LTD., Hangzhou, Zhejiang Province (CN); HANGZHOU GREAT STAR INDUSTRIAL CO., LTD., Hangzhou, Zhejiang Province (CN)

( * ) Notice: Subject to any disclaimer, the term of this patent is extended or adjusted under 35 U.S.C. 154(b) by 0 days.

(21) Appl. No.: 14/369,739

(22) PCT Filed: May 26, 2014

(86) PCT No.: PCT/CN2014/078401
§ 371 (c)(1),
(2) Date: Jun. 30, 2014

(87) PCT Pub. No.: WO2015/180012
PCT Pub. Date: Dec. 3, 2015

(65) Prior Publication Data

US 2017/0066111 A1 Mar. 9, 2017

(51) Int. Cl.
*B25B 7/10* (2006.01)
*B25B 7/14* (2006.01)

(52) U.S. Cl.
CPC . *B25B 7/10* (2013.01); *B25B 7/14* (2013.01)

(58) Field of Classification Search
CPC ..... B25B 7/10; B25B 7/14
(Continued)

(56) References Cited

U.S. PATENT DOCUMENTS 132,057 A * 10/1872 Cooper ..... B25B 13/12 269/213
620,485 A * 2/1899 McCune ..... B25B 13/14 81/165

(Continued)

FOREIGN PATENT DOCUMENTS

CN 2288818 Y 8/1998
CN 1791494 A 6/2006

(Continued)

OTHER PUBLICATIONS

Supplemental European Search Report dated May 10, 2017 for EP Application 14 89 3477.

*Primary Examiner* — Hadi Shakeri
(74) *Attorney, Agent, or Firm* — McCormick, Paulding & Huber LLP

(57) ABSTRACT

A wrench with translational wrench jaw comprises a first wrench jaw, a first handle and a connection portion; a second handle and a second wrench jaw; a first connecting rod, connected with the first handle, a first end of the first connecting rod being arranged with an elastic component; a second connecting rod, connected with the second handle, a first end of the second connecting rod being arranged with an elastic component, the second end of the first connecting rod being connected with the second end of the second connecting rod. The wrench with translational wrench jaw provided by the present invention is suitable for gripping various workpieces; adopting two-stage transmission can provide greater gripping force, being more efficient and avoiding structural damage, thus prolonging the service life; By adopting locking mechanism can release operator's hands and be more convenient.

14 Claims, 4 Drawing Sheets

(58) Field of Classification Search
USPC ..... 81/318, 358, 409.5, 413
See application file for complete search history.

(56) References Cited

U.S. PATENT DOCUMENTS

| | | | | |
|---|---|---|---|---|
| 4,893,530 | A | 1/1990 | Warheit | |
| 6,000,303 | A | 12/1999 | Chang | |
| 6,065,376 | A * | 5/2000 | Khachatoorian | B25B 7/12 81/341 |
| 6,116,124 | A * | 9/2000 | Ping | B25B 7/10 81/319 |
| 7,299,724 | B1 * | 11/2007 | Warheit | B25B 7/10 81/321 |
| 7,503,243 | B2 * | 3/2009 | Putsch | B25B 7/10 81/409.5 |
| 7,669,505 | B2 * | 3/2010 | Campbell | B25B 7/04 81/331 |
| 8,561,506 | B2 * | 10/2013 | Buchanan | B25B 7/10 81/378 |
| 2006/0137497 | A1 | 6/2006 | Whiteford | |
| 2007/0169592 | A1 | 7/2007 | Putsch | |
| 2009/0293685 | A1 | 12/2009 | Campbell et al. | |
| 2013/0199342 | A1 | 8/2013 | Peirce | |

FOREIGN PATENT DOCUMENTS

| | | |
|---|---|---|
| CN | 202846394 U | 4/2013 |
| DE | 20302867 U1 | 5/2003 |

* cited by examiner

WRENCH WITH TRANSLATIONAL WRENCH JAW

FIELD OF THE INVENTION

The present invention relates to a hand tool for gripping workpieces, more particularly, to a wrench with translational wrench jaw.

DESCRIPTION OF THE PRIOR ART

Wrench with translational wrench jaw is a hand tool for gripping workpieces, which is suitable for gripping various workpieces such as plates, bolts, nuts, pipe fittings, and the like.

A wrench with wrench jaws being able to open automatically can be operated by single hand when gripping workpiece without beforehand adjustment of the wrench jaws according to the size of the workpiece, which means that it is convenient to adjust the two wrench jaws to the size of the workpiece as long as the workpiece can be put into the opening between them.

When using a wrench to grip a workpiece under normal conditions, a user is required to apply forces to the handles and the forces are transmitted to the wrench jaws via handles and the wrench jaws to apply gripping forces to the workpiece. In practice, the gripping forces are often required to remain when the user loosen the handles.

Therefore, a person skilled in the art devotes to develop a wrench with translational wrench jaw. The wrench is provided with a locking mechanism and the wrench jaw is able to open automatically.

SUMMARY OF THE INVENTION

The present invention provides a wrench with translational wrench jaw, comprising:

a first wrench jaw, a first handle and a connecting portion connecting the first wrench jaw and the first handle, the connecting portion being arranged with a long hole, the long hole being provided with a first flank and a second flank which are parallel to each other, and the first flank being arranged with teeth;

a second handle, connected with the connecting portion via a claw arranged in the long hole, the second handle being connected with the claw via a first pin pivot, the first end of the second handle being arranged with a cam;

a second wrench jaw, connected with the connecting portion in a sliding manner, the second wrench jaw being arranged with a recess to accommodate the cam;

a first connecting rod, connected with the first handle via a second pin pivot, a first end of the first connecting rod being arranged with a first elastic component, which is used for the restoration of the first connecting rod;

a second connecting rod, connected with the second handle via a third pin pivot, a first end of the second connecting rod being arranged with a second elastic component, which is used for the restoration of the second connecting rod, the second end of the first connecting rod being connected with the second end of the second connecting rod via a fourth pin pivot;

when a workpiece is placed between the first wrench jaw and the second wrench jaw, apply forces in opposite directions respectively to the first handle and the second handle to make the first handle and the second handle move toward each other, the second handle rotating around the first pin pivot, which makes the second wrench jaw translate toward the first wrench jaw until the translation of the second wrench jaw is limited by the workpiece; the second connecting rod drives the second handle to move toward the second wrench jaw in order that the claw engages with the teeth on the first flank; keep on applying the forces in the opposite directions, and the second handle rotates around the first pin pivot, producing gripping forces greater than the forces in the opposite directions and transmitting the gripping forces to the gripping face of the first wrench jaw and the gripping face of the second wrench jaw.

The wrench with translational wrench jaw provided by the present invention, wherein the first wrench jaw is a fixed wrench jaw, the second wrench jaw is a movable wrench jaw. When an operator applies forces to the first handle and the second handle, the claw connected with the first end of the second handle moves along the second flank of the long hole of the connecting portion to drive the second wrench jaw to translate toward or away from the first wrench jaw, thus constituting a wrench with translational wrench jaw.

When no external force is applied to the handles of the wrench with translational wrench jaw, the force produced by the second elastic component to the second connecting rod makes the second connecting rod and the first connecting rod unfolded, thus making the second wrench jaw and the first wrench jaw in a position of the maximal tensile degree.

When external forces are applied to the handles of the wrench with translational wrench jaw, the second elastic component undergoes an elastic deformation, and the second wrench jaw translates toward the first wrench jaw, the tensile degree between the second wrench jaw and the first wrench jaw decreasing until the workpiece being contacted; when the external forces are removed, under the action of the force produced by the elastic deformation of the second elastic component, the second connecting rod and the first connecting rod unfold, and the second wrench jaw translates away from the first wrench jaw to make the second wrench jaw and the first wrench jaw in a position of the maximal tensile degree.

The wrench with translational wrench jaw provided by the present invention, wherein the wrench jaws are able to open automatically without manual operation to open the wrench jaws beforehand, and thus the wrench with translational wrench jaw can be conveniently operated by single hand to grip the workpiece.

When external forces are applied to the handles of the wrench with translational wrench jaw, the second elastic component undergoes an elastic deformation, and the second wrench jaw translates toward the first wrench jaw, the tensile degree between the second wrench jaw and the first wrench jaw decreasing until the workpiece being contacted; then continue applying the external forces, and the second wrench jaw suffers a force from the workpiece in the direction away from the first wrench jaw, the force being transmitted to the cam of the second handle via the recess of the second wrench jaw; the elastic force of the first elastic component acts on the first end of the first connecting rod, the direction of which is away from the wrench jaw along the first handle, while the elastic force produces a force in opposite direction on the second end of the first connecting rod, which acts on the second connecting rod via the fourth pin pivot and then acts on the second handle via the third pin pivot. Under the combined action of the force from the workpiece to the cam, the elastic force from the first elastic component to the third pin pivot, the external force to the handles and the elastic force from the second elastic component to the second handle, the second handle moves toward the first flank of the long hole of the connecting portion, which makes the claw engage with the teeth of the first flank, and in this case, the second wrench jaw cannot slide relative to the connecting portion; further continue applying the forces in opposite directions, the second handle rotates around the first pin pivot, and the cam rotates, then the fourth pin pivot moves away from the connecting component; the arm of the acting force is the distance from the acting point of the external force on the handle of the wrench with translational wrench jaw to the first pin pivot, the arm of resistance force is the distance from the edge of the cam to the first pin pivot, therefore the second handle is a labour-saving lever, which is able to produce greater gripping forces and transmit them to the gripping faces of the first wrench jaw and the second wrench jaw.

The wrench with translational wrench jaw provided by the present invention adopts two-stage transmission, wherein the first-stage transmission is used for translation of the wrench jaw, and the second-stage transmission is used for providing greater gripping forces; it is the first-stage transmission when the claw does not engage with the teeth of the first flank, and it is the second-stage transmission when the claw engages with the teeth of the first flank, which is more efficient.

By adopting two-stage transmission, when the external forces are no longer applied to the handles of the wrench with translational wrench jaw, first under the action of the elastic force of the first elastic component, the first connecting rod rotates, which makes the fourth pin pivot move toward the connecting portion, removing the great gripping forces between the first wrench jaw and the second wrench jaw; in this case, the claw disengages from the teeth of the first flank, avoiding structural damage, thus prolonging the service life of the wrench with translational wrench jaw.

Further, the wrench with translational wrench jaw is made of plate, adopting plate in high strength via laminated die cutting and riveting.

Further, the material of the plate is steel or iron.

Further, the second wrench jaw is connected with the connecting portion in a sliding manner via a sliding block arranged in the long hole. The second wrench jaw, which is made of multilayered plate, is riveted to the sliding block via the outer layers of the plate, forming a sliding connection between the second wrench jaw and the connecting portion. When the sliding block moves along the second flank of the long hole, the second wrench jaw translates toward or away from the first wrench jaw.

Further, the first edge of the connecting portion facing the second wrench jaw parallels to the first flank of the long hole of the connecting portion; the second wrench jaw is provided with a groove, and a gap is arranged between the first edge and the groove to enable the groove to move along the first edge. The middle layers of the plate of the second wrench jaw are shorter than the outer layers to form a groove, and a gap is arranged between the first edge and the groove to enable the groove to move along the first edge, further to ensure that the second wrench jaw translates toward or away from the first wrench jaw when the sliding block moves along the second flank of the long hole.

Further, the wrench with translational wrench jaw is made by forging process.

Further, a guide slot, which is parallel to the first flank of the long hole of the connecting portion, is arranged on the connecting portion. The second wrench jaw is provided with a groove, and a long strip protrusion is arranged on the flank facing the connecting portion thereof. The long strip protrusion is embedded in the guide slot to form a sliding connection between the second wrench jaw and the connecting portion. When the long strip protrusion moves along the guide slot, the second wrench jaw translates toward or away from the first wrench jaw.

Further, the first elastic component is a tension spring.

Further, the first connecting rod is in straight shape, and a stop block is arranged on the first handle. To further prevent the rotating angle of the first connecting rod from being too large, the fourth pin pivot is at or across the link line of the second pin pivot and the third pin pivot to lock the connecting mechanism.

Further, the first connecting rod is in folded shape. To further prevent the rotating angle of the first connecting rod from being too large, the fourth pin pivot crosses the link line of the second pin pivot and the third pin pivot to lock the connecting mechanism.

Further, the second elastic component is a torsion spring.

When no external force is applied to the handles of the wrench with translational wrench jaw, the torsional force produced by the torsion spring to the second connecting rod makes the second connecting rod and the first connecting rod unfolded, thus making the second wrench jaw and the first wrench jaw in a position of the maximal tensile degree.

When external forces are applied to the handles of the wrench with translational wrench jaw, the torsion spring is twisted, and the second wrench jaw translates toward the first wrench jaw, the tensile degree between the second wrench jaw and the first wrench jaw decreasing until the workpiece being contacted; when the external forces are removed, under the action of the torsional force produced by the torsion spring, the second connecting rod and the first connecting rod unfold, and the second wrench jaw translates away from the first wrench jaw to make the second wrench jaw and the first wrench jaw in a position of the maximal tensile degree.

The wrench with translational wrench jaw provided by the present invention, wherein the wrench jaws are able to open automatically without manual operation to open the wrench jaws beforehand, and thus the wrench with translational wrench jaw can be conveniently operated by single hand to grip the workpiece.

Further, the second elastic component is a tension spring.

When no external force is applied to the handles of the wrench with translational wrench jaw, the tensile force produced by the tension spring to the second connecting rod makes the second connecting rod and the first connecting rod unfolded, thus making the second wrench jaw and the first wrench jaw in a position of the maximal tensile degree.

When external forces are applied to the handles of the wrench with translational wrench jaw, the tension spring is stretched, and the second wrench jaw translates toward the first wrench jaw, the tensile degree between the second wrench jaw and the first wrench jaw decreasing until the workpiece being contacted; when the external forces are removed, under the action of the tensile force produced by the tension spring, the second connecting rod and the first connecting rod unfold, and the second wrench jaw translates away from the first wrench jaw to make the second wrench jaw and the first wrench jaw in a position of the maximal tensile degree.

The wrench with translational wrench jaw provided by the present invention, wherein the wrench jaws are able to open automatically without manual operation to open the wrench jaws beforehand, and thus the wrench with translational wrench jaw can be conveniently operated by single hand to grip the workpiece.

Further, the wrench with translational wrench jaw further comprises a locking mechanism for preventing the movement of the second wrench jaw away from the first wrench jaw.

When the wrench with translational wrench jaw is in the position of gripping a workpiece, the locking mechanism can be used to keep the gripping status, without applying any force to the handles of the wrench with translational wrench jaw, and thus the operator's hands can be released to complete other operations under the gripping status.

Further, the locking mechanism comprises a first end of the second connecting rod and a third connecting rod, the first end of the second connecting rod is in fan shape, and teeth are arranged on the edge of the fan shape. The first end of the third connecting rod is connected with the second handle via a fifth pin pivot, and a pushing button is arranged on the second end of the third connecting rod, and teeth are arranged on the flank of the third connecting rod, which faces the first end of the second connecting rod.

When the teeth of the third connecting rod engage with the teeth of the edge of the fan shape of the second connecting rod, the unfolding of the second connecting rod and the first connecting rod under the action of the second elastic component is prevented, thus preventing the translation of the second wrench jaw away from the first wrench jaw to keep the opening degree between the second wrench jaw and the first wrench jaw.

Apply external forces on the handles of the wrench with translational wrench jaw, and the opening degree between the second wrench jaw and the first wrench jaw can be further decreased.

When the opening degree between the second wrench jaw and the first wrench jaw does not need to be kept, push the pushing button away from the second wrench jaw, then the teeth of the third connecting rod no longer engage with the teeth of the edge of the fan shape of the second connecting rod; under the action of the second elastic component, the second connecting rod and the first connecting rod unfold, and the second wrench jaw translates away from the first wrench jaw to make the second wrench jaw and the first wrench jaw in a position of maximal tensile degree.

Further, a neck is arranged on the second handle. The neck is used to limit the position of the pushing button to make the pushing button in the position of the disengagement of the teeth of the third connecting rod and the teeth of the edge of the fan shape of the second connecting rod, i.e. the locking mechanism is in the unlocking position.

Further, the locking mechanism comprises a third elastic component, which is used to apply force to the third connecting rod toward the second connecting rod. When the teeth of the third connecting rod engage with the teeth of the edge of the fan shape of the second connecting rod, the engagement between the teeth is stable; even if external forces are applied to the handles of the wrench with translational wrench jaw and the opening degree between the second wrench jaw and the first wrench jaw is further decreased, the teeth can still engage with each other stably again after disengagement, thus the locking mechanism can prevent the movement of second wrench jaw away from the first wrench jaw stably and reliably.

Further, the third elastic component is a torsion spring.

Further, a scale is arranged on the connecting portion for measuring the distance between the first wrench jaw and the second wrench jaw.

The wrench with translational wrench jaw provided by the present invention has following beneficial effects:

A. The translational wrench jaw is suitable for gripping various workpieces, such as circular tubes, slabs, bolts, nuts, and the like.

B. The invention adopts two-stage transmission, wherein the first-stage transmission is used for the translation of the wrench jaw, and the second-stage transmission is used for providing greater gripping force; it is the first-stage transmission when the claw does not engage with the teeth of the first flank, and it is the second-stage transmission when the claw engages with the teeth of the first flank, which can provide a greater gripping force and is more efficient. By adopting two-stage transmission, when the external forces are no longer applied to the handles of the wrench with translational wrench jaw, first under the action of the elastic force of the first elastic component, the first connecting rod rotates, which makes the fourth pin pivot move toward the connecting portion, removing the great gripping forces between the first wrench jaw and the second wrench jaw; in this case, the claw disengages from the teeth of the first flank, avoiding structural damage, thus prolonging the service life of the wrench with translational wrench jaw.

C. The wrench with translational wrench jaw further comprises a locking mechanism for preventing the movement of the second wrench jaw away from the first wrench jaw. When the wrench with translational wrench jaw is in the position of gripping a workpiece, the locking mechanism can be used to keep gripping status, without applying any force to the handles of the wrench with translational wrench jaw, and thus the operator's hands can be released to complete other operations under the gripping status.

A further description will be made as to the conception, detailed structure, and expected technical effects of the present invention with reference to the accompanying drawings to make the objects, features, and advantages of the present invention fully understood.

DETAILED DESCRIPTION OF THE PREFERRED EMBODIMENTS

Figure 1:
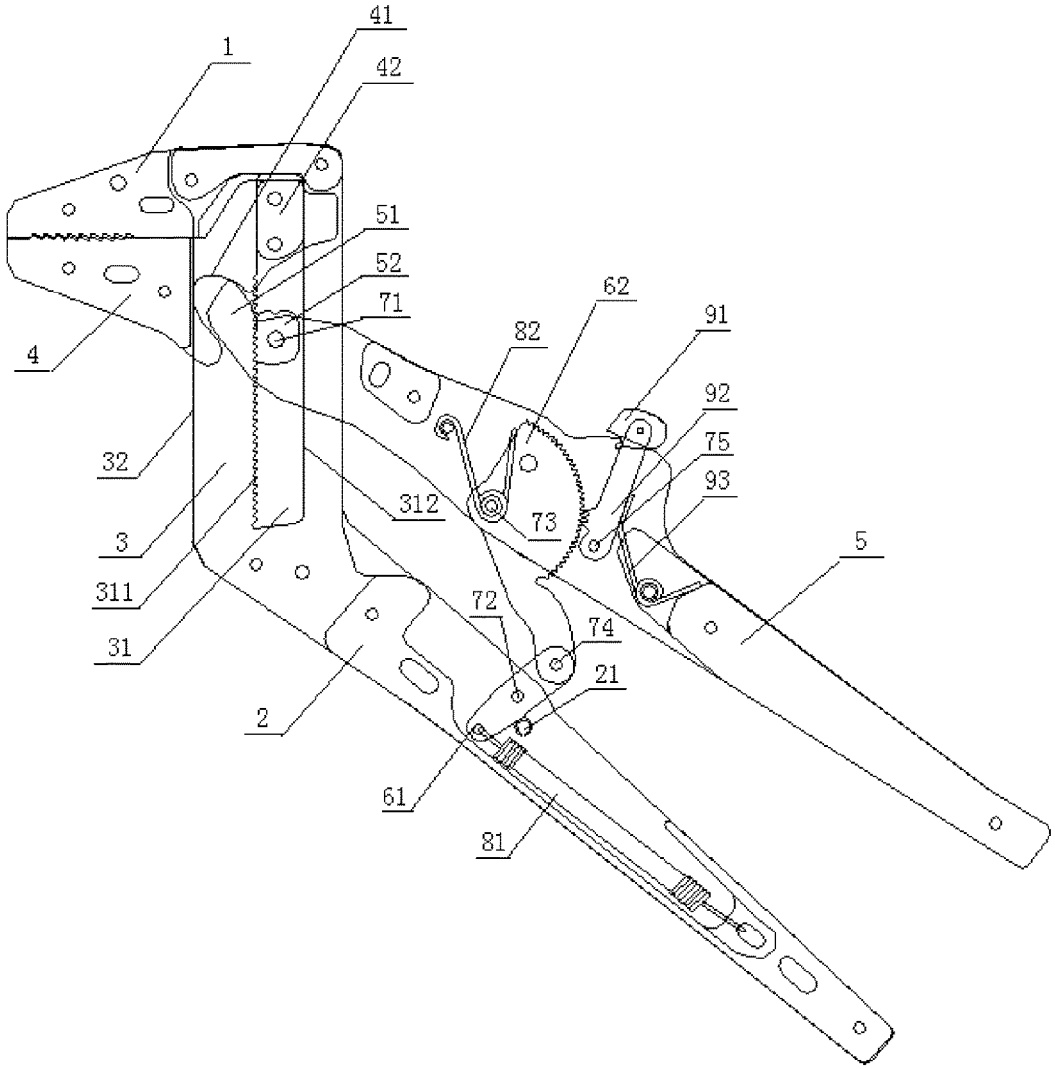
FIG. 1 is a structural schematic view of one embodiment of the wrench with translational wrench jaw of the present invention.
Figure 2:
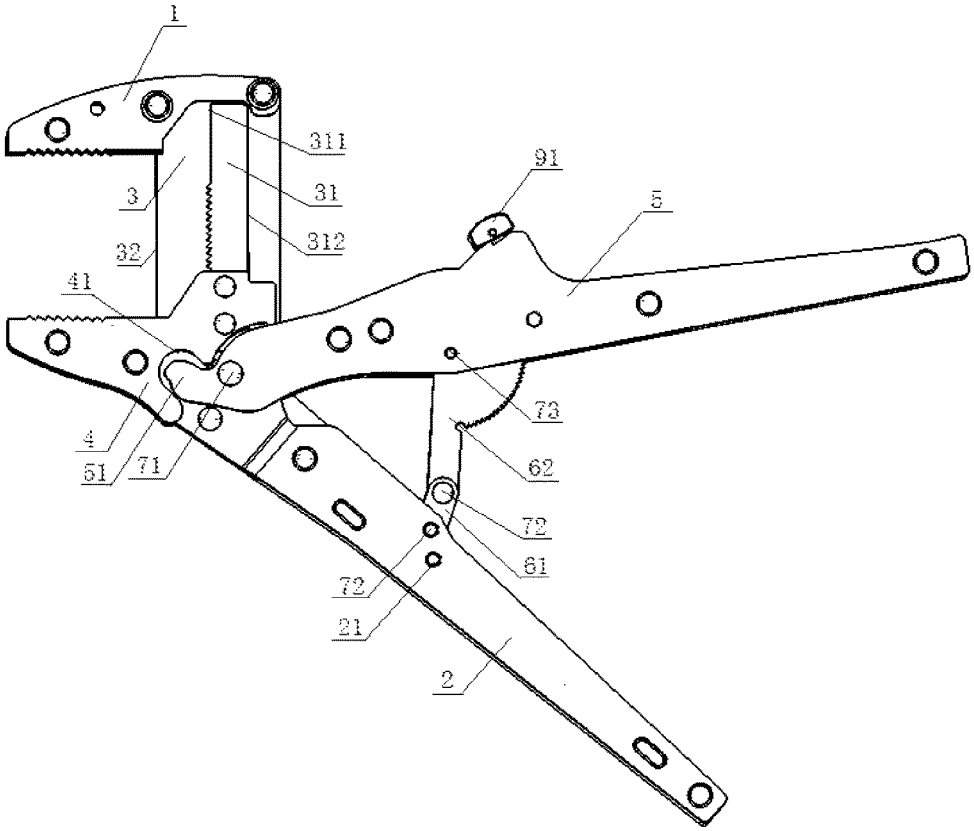
FIG. 2 is a structural schematic view of the wrench jaw of the wrench with translational wrench jaw shown in FIG. 1 wherein the opening is to the maximum.

As shown in FIG. 1 and FIG. 2, a wrench with translational wrench jaw of one embodiment of the present invention comprises:

a first wrench jaw 1, a first handle 2 and a connecting portion 3 connecting the first wrench jaw 1 and the first handle 2, the connecting portion 3 being arranged with a long hole 31, the long hole 31 being provided with a first flank 311 and a second flank 312 which are parallel to each other, and the first flank 311 being arranged with teeth; a second handle 5, connected with the connecting portion 3 via a claw 52 arranged in the long hole 31, the second handle 5 being connected with the claw 52 via a first pin pivot 71, the first end of the second handle 5 being arranged with a cam 51;

a second wrench jaw 4, connected with the connecting portion 3 in a sliding manner, the second wrench jaw being arranged with a recess 41 to accommodate the cam 51; a first connecting rod 61, connected with the first handle 2 via a second pin pivot 72, a first end of the first connecting rod 61 being arranged with a first elastic component 81, which is used for the restoration of the first connecting rod 61;

a second connecting rod 62, connected with the second handle 5 via a third pivot 73, a first end of the second connecting rod 62 being arranged with a second elastic component 82, which is used for the restoration of the second connecting rod, the second end of the first connecting rod 61 being connected with the second end of the second connecting rod 62 via a fourth pin pivot 74;

when a workpiece is placed between the first wrench jaw 1 and the second wrench jaw 4, apply forces in opposite directions respectively to the first handle 2 and the second handle 5 to make the first handle 2 and the second handle 5 move toward each other, the second handle 5 rotating around the first pin pivot 71, which makes the second wrench jaw 4 translate toward the first wrench jaw 1 until the translation of the second wrench jaw 4 is limited by the workpiece; the second connecting rod 62 drives the second handle 5 to move toward the second wrench jaw 4 in order that the claw 52 engages with the teeth on the first flank 311; keep on applying the forces in the opposite directions, and the second handle 5 rotates around the first pin pivot 71, producing gripping forces greater than the forces in the opposite directions and transmitting the gripping forces to the gripping face of the first wrench jaw 1 and the gripping face of the second wrench jaw 4.

The wrench with translational wrench jaw of the embodiment, wherein the first wrench jaw 1 is a fixed wrench jaw, the second wrench jaw 4 is a movable wrench jaw. When an operator applies forces to the first handle 2 and the second handle 5, the claw 52 connected with the first end of the second handle 5 moves along the second flank 312 of the long hole 31 of the connecting portion 3 to drive the second wrench jaw 4 to translate toward or away from the first wrench jaw 1, thus constituting a wrench with translational wrench jaw.

When no external force is applied to the handles of the wrench with translational wrench jaw, the force produced by the second elastic component 82 to the second connecting rod 62 makes the second connecting rod 62 and the first connecting rod 61 unfolded, thus making the second wrench jaw 4 and the first wrench jaw 1 in a position of the maximal tensile degree.

When external forces are applied to the handles of the wrench with translational wrench jaw, the second elastic component 82 undergoes an elastic deformation, and the second wrench jaw 4 translates toward the first wrench jaw 1, the tensile degree between the second wrench jaw 4 and the first wrench jaw 1 decreasing until the workpiece being contacted; when the external forces are removed, under the action of the force produced by the elastic deformation of the second elastic component 82, the second connecting rod 62 and the first connecting rod 61 unfold, and the second wrench jaw 4 translates away from the first wrench jaw 1 to make the second wrench jaw 4 and the first wrench jaw 1 in a position of the maximal tensile degree.

The wrench with translational wrench jaw of the embodiment, wherein the wrench jaws are able to open automatically without manual operation to open the wrench jaws beforehand, and thus the wrench with translational wrench jaw can be conveniently operated by single hand to grip the workpiece.

When external forces are applied to the handles of the wrench with translational wrench jaw, the second elastic component 82 undergoes an elastic deformation, and the second wrench jaw 4 translates toward the first wrench jaw 1, the tensile degree between the second wrench jaw 4 and the first wrench jaw 1 decreasing until the workpiece being contacted; then continue applying the external forces, the second wrench jaw 4 suffers a force from the workpiece in the direction away from the first wrench jaw 1, the force being transmitted to the cam 51 of the second handle 5 via the recess 41 of the second wrench jaw 4; the elastic force of the first elastic component 81 acts on the first end of the first connecting rod 61, the direction of which is away from the wrench jaw along the first handle 2, while the elastic force produces a force in opposite direction on the second end of the first connecting rod 61, which acts on the second connecting rod 62 via the fourth pin pivot 74 and then acts on the second handle 5 via the third pin pivot 73. Under the combined action of the force from the workpiece to the cam 51, the elastic force from the first elastic component 81 to the third pin pivot 73, the external force to the handles and the elastic force from the second elastic component 82 to the second handle 5, the second handle 5 moves toward the first flank 311 of the long hole 31 of the connecting portion 3, which makes the claw 52 engage with the teeth of the first flank 311, and in this case, the second wrench jaw 4 cannot slide relative to the connecting portion 3; further continue applying the forces in opposite directions, the second handle 5 rotates around the first pin pivot 71, and the cam 51 rotates, then the fourth pin pivot 74 moves away from the connecting component; the arm of the acting force is the distance from the acting point of the external force on the handle of the wrench with translational wrench jaw to the first pin pivot 71, the arm of resistance force is the distance from the edge of the cam 51 to the first pin pivot 71, therefore the second handle 5 is a labour-saving lever, which is able to produce greater gripping forces and transmit them to the gripping faces of the first wrench jaw 1 and the second wrench jaw 4.

The wrench with translational wrench jaw of the embodiment adopts two-stage transmission, wherein the first-stage transmission is used for the translation of the wrench jaw, and the second-stage transmission is used for providing greater gripping forces; it is the first-stage transmission when the claw 52 does not engage with the teeth of the first flank 311, and it is the second-stage transmission when the claw 52 engages with the teeth of the first flank 311, which is more efficient.

By adopting two-stage transmission, when the external forces are no longer applied to the handles of the wrench with translational wrench jaw, first under the action of the elastic force of the first elastic component 81, the first connecting rod 61 rotates, which makes the fourth pin pivot 74 move toward the connecting portion 3, removing the great gripping forces between the first wrench jaw 1 and the second wrench jaw 4; in this case, the claw 52 disengages from the teeth of the first flank 311, avoiding structural damage, thus prolonging the service life of the wrench with translational wrench jaw.

The wrench with translational wrench jaw of the embodiment is made of plate, adopting plate in high strength via laminated die cutting and riveting. The material of the plate is steel or iron.

Figure 5:
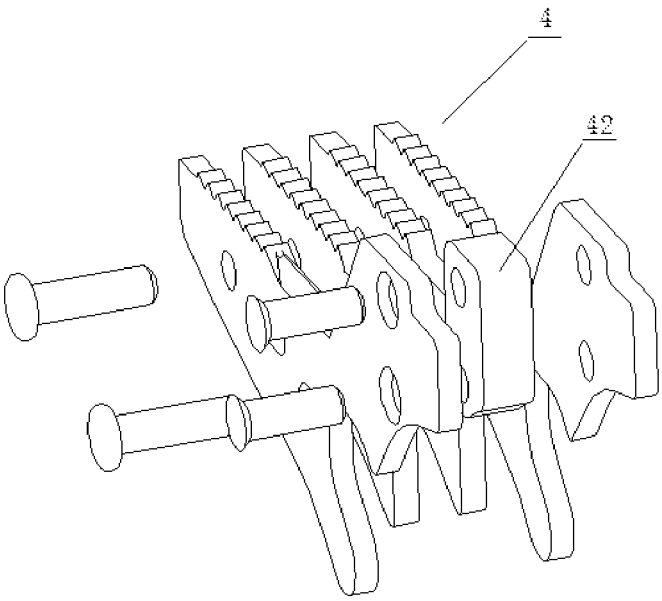
FIG. 5 is a structural schematic view of the multilayered plate of the mobile wrench jaw of the wrench with translational wrench jaw shown in FIG. 1.

The second wrench jaw 4 is connected with the connecting portion 3 in a sliding manner via a sliding block 42 arranged in the long hole 31. As shown in FIG. 5, the second wrench jaw 4 is made of multilayered plate. The second wrench jaw 4 of the wrench with translational wrench jaw of the embodiment is made of 4-layered plate and is riveted to the sliding block 42 via the outer layers of the plate, forming a sliding connection between the second wrench jaw 4 and the connecting portion 3. When the sliding block 42 moves along the second flank 312 of the long hole 31, the second wrench jaw 4 translates toward or away from the first wrench jaw 1.

The first edge 32 of the connecting portion 3 facing the second wrench jaw 4 parallels to the first flank 311 of the long hole 31 of the connecting portion 3; the second wrench jaw 4 is provided with a groove, and a gap is arranged between the first edge 32 and the groove to enable the groove to move along the first edge 32.

The wrench with translational wrench jaw of the embodiment, wherein the second wrench jaw 4 is made of 4-layered plate, the middle two layers thereof are shorter than the outer layers to form a groove, and a gap is arranged between the first edge 32 and the groove to enable the groove to move along the first edge, further to ensure that the second wrench jaw 4 translates toward or away from the first wrench jaw 1 when the sliding block 42 moves along the second flank 312 of the long hole 31.

The first elastic component 81 is a tension spring.

The first connecting rod 61 is in straight shape, and a stop block 21 is arranged on the first handle 2. To further prevent the rotation angle of the first connecting rod 61 from being too large, the fourth pin pivot 74 is at or across the link line of the second pin pivot 72 and the third pin pivot 73, which causes the connecting rod mechanism to get stuck.

The second elastic component 82 is a torsion spring.

When no external force is applied to the handles of the wrench with translational wrench jaw, the torsional force produced by the torsion spring 82 to the second connecting rod 62 makes the second connecting rod 62 and the first connecting rod 61 unfolded, thus making the second wrench jaw 4 and the first wrench jaw 1 in a position of the maximal tensile degree.

When external forces are applied to the handles of the wrench with translational wrench jaw, the torsion spring 82 is twisted, and the second wrench jaw 4 translates toward the first wrench jaw 1, the tensile degree between the second wrench jaw 4 and the first wrench jaw 1 decreasing until the workpiece being contacted; when the external forces are removed, under the action of the torsional force produced by the torsion spring 82, the second connecting rod 62 and the first connecting rod 61 unfold, and the second wrench jaw 4 translates away from the first wrench jaw 1 to make the second wrench jaw 4 and the first wrench jaw 1 in a position of the maximal tensile degree.

The wrench with translational wrench jaw of the embodiment, wherein the wrench jaws are able to open automatically without manual operation to open the wrench jaws beforehand, and thus the wrench with translational wrench jaw can be conveniently operated by single hand to grip the workpiece.

The wrench with translational wrench jaw further comprises a locking mechanism for preventing the movement of the second wrench jaw 4 away from the first wrench jaw 1.

When the wrench with translational wrench jaw is in the position of gripping a workpiece, the locking mechanism can be used to keep the gripping status, without applying any force to the handles of the wrench with translational wrench jaw, and thus the operator's hands can be released to complete other operations under the gripping status.

Figure 3:
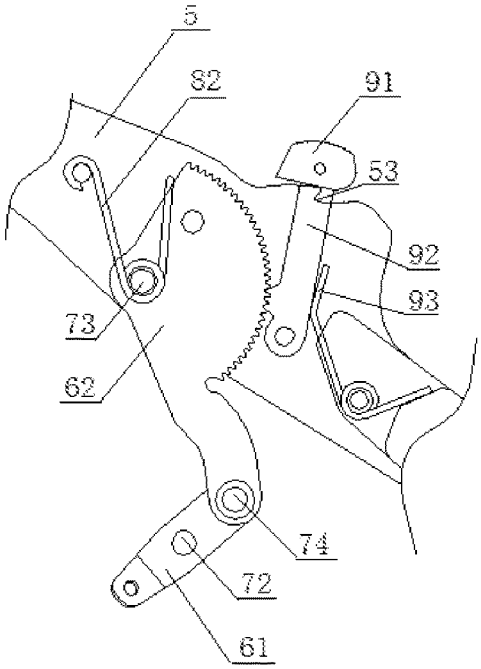
FIG. 3 is a structural schematic view of the locking mechanism of the wrench with translational wrench jaw shown in FIG. 1 wherein the locking mechanism is in the locking position.
Figure 4:
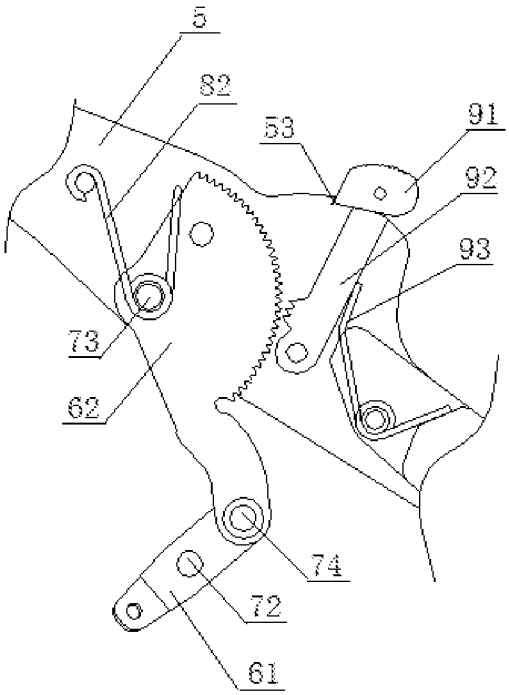
FIG. 4 is a structural schematic view of the locking mechanism of the wrench with translational wrench jaw shown in FIG. 1 wherein the locking mechanism is in the unlocking position.

As shown in FIG. 3 and FIG. 4, the locking mechanism comprises a first end of the second connecting rod 62 and a third connecting rod 92, the first end of the second connecting rod 62 is in fan shape, and teeth are arranged on the edge of the fan shape. The first end of the third connecting rod 92 is connected with the second handle 5 via a fifth pin pivot, and a pushing button 91 is arranged on the second end of the third connecting rod 92, and teeth are arranged on the flank of the third connecting rod 92, which faces the first end of the second connecting rod 62.

When the teeth of the third connecting rod 92 engage with the teeth of the edge of the fan shape of the second connecting rod 62, the unfolding of the second connecting rod 62 and the first connecting rod 61 under the action of the second elastic component 82 is prevented, thus preventing the translation of the second wrench jaw 4 away from the first wrench jaw 1 to keep the opening degree between the second wrench jaw 4 and the first wrench jaw 1.

Apply external forces on the handles of the wrench with translational wrench jaw, and the opening degree between the second wrench jaw 4 and the first wrench jaw 1 can be further decreased.

When the opening degree between the second wrench jaw 4 and the first wrench jaw 1 does not need to be kept, push the pushing button away from the second wrench jaw 4, then the teeth of the third connecting rod 92 no longer engage with the teeth of the edge of the fan shape of the second connecting rod 62; under the action of the second elastic component 82, the second connecting rod 62 and the first connecting rod 61 unfold, and the second wrench jaw 4 translates away from the first wrench jaw 1 to make the second wrench jaw 4 and the first wrench jaw 1 in a position of maximal tensile degree.

A neck 53 is arranged on the second handle 5. The neck 53 is used to limit the position of the pushing button 91. As shown in FIG. 3, when the pushing button 91 is not stuck in the neck 53, the teeth of the third connecting rod 92 engage with the teeth of the edge of the fan shape of the second connecting rod, i.e. the locking mechanism is in the locking position; as shown in FIG. 4, when the pushing button 91 is stuck in the neck 53, the teeth of the third connecting rod 92 do not engage with the teeth of the edge of the fan shape of the second connecting rod, i.e. the locking mechanism is in the unlocking position The locking mechanism comprises a third elastic component 93, which is used to apply force to the third connecting rod 92 toward the second connecting rod 62. When the teeth of the third connecting rod 92 engage with the teeth of the edge of the fan shape of the second connecting rod 62, the engagement between the teeth is stable; even if external forces are applied to the handles of the wrench with translational wrench jaw and the opening degree between the second wrench jaw 4 and the first wrench jaw 1 is further decreased, the teeth can still engage with each other stably again after disengagement, thus the locking mechanism can prevent the movement of the second wrench jaw 4 away from the first wrench jaw 1 stably and reliably.

The third elastic component 92 of the wrench with translational wrench jaw of the embodiment is a torsion spring.

A scale is arranged on the connecting portion 3 for measuring the distance between the first wrench jaw 1 and the second wrench jaw 4.

Figure 6:
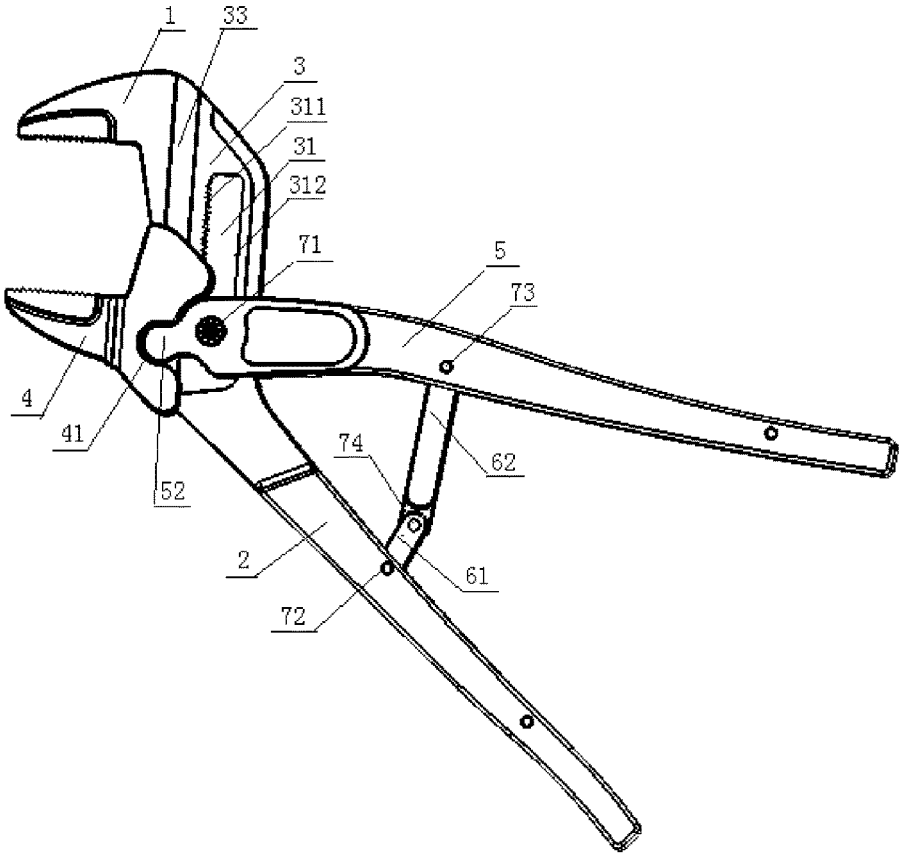
FIG. 6 is a structural schematic view of another embodiment of the wrench with translational wrench jaw.
Figure 7:
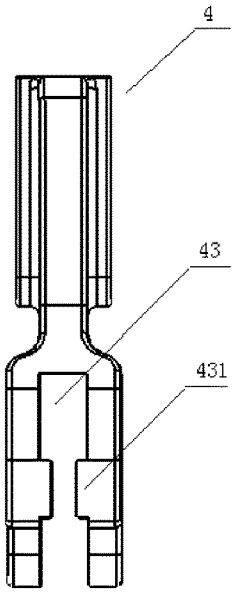
FIG. 7 is a lateral view of the mobile wrench jaw of the wrench with translational wrench jaw shown in FIG. 6.

As shown in FIG. 6, the wrench with translational wrench jaw of another embodiment of the present invention comprises:

a first wrench jaw 1, a first handle 2 and a connecting portion 3 connecting the first wrench jaw 1 and the first handle 2, the connecting portion 3 being arranged with a long hole 31, the long hole 31 being provided with a first flank 311 and a second flank 312 which are parallel to each other, and the first flank 311 being arranged with teeth; a second handle 5, connected with the connecting portion 3 via a claw arranged in the long hole 31, the second handle 5 being connected with the claw via a first pin pivot 71, the first end of the second handle 5 being arranged with a cam 51;

a second wrench jaw 4, connected with the connecting portion 3 in a sliding manner, the second wrench jaw being arranged with a recess 41 to accommodate the cam 51;

a first connecting rod 61, connected with the first handle 2 via a second pin pivot 72, a first end of the first connecting rod 61 being arranged with a first elastic component, which is used for the restoration of the first connecting rod 61;

a second connecting rod 62, connected with the second handle 5 via a third pin pivot 73, a first end of the second connecting rod 62 being arranged with a second elastic component, which is used for the restoration of the second rod, the second end of the first connecting rod 61 being connected with the second end of the second connecting rod 62 via a fourth pin pivot 74;

a guide slot 33, which is parallel to the first flank 311 of the long hole 31 of the connecting portion 3, being arranged on the connecting portion 3; as shown in FIG. 7, the second wrench jaw 4 being provided with a groove 43, a long strip protrusion 431 being arranged on the flank facing the connecting portion thereof, and the long strip protrusion 431 being embedded in the guide slot 33 to form a sliding connection between the second wrench jaw 4 and the connecting portion 3; when the long strip protrusion 431 moving along the guide slot 33, the second wrench jaw 2 translating toward or away from the first wrench jaw 1.

The wrench with translational wrench jaw of the embodiment is made by forging process.

The first elastic component is a tension spring.

The second elastic component is a tension spring.

When no external force is applied to the handles of the wrench with translational wrench jaw, the tensile force produced by the tension spring to the second connecting rod 62 makes the second connecting rod 62 and the first connecting rod 61 unfolded, thus making the second wrench jaw 4 and the first wrench jaw 1 in a position of the maximal tensile degree.

When external forces are applied to the handles of the wrench with translational wrench jaw, the tension spring is stretched, and the second wrench jaw 4 translates toward the first wrench jaw 1, the tensile degree between the second wrench jaw 4 and the first wrench jaw 1 decreasing until the workpiece being contacted; when the external forces are removed, under the action of the tensile force produced by the tension spring, the second connecting rod 62 and the first connecting rod 61 unfold, and the second wrench jaw 4 translates away from the first wrench jaw 1 to make the second wrench jaw 4 and the first wrench jaw 1 in a position of the maximal tensile degree.

The wrench with translational wrench jaw of the embodiment, wherein the wrench jaws are able to open automatically without manual operation to open the wrench jaws beforehand, and thus the wrench with translational wrench jaw can be conveniently operated by single hand to grip the workpiece.

The first connecting rod 61 is in folded shape. To further prevent the rotating angle of the first connecting rod from being too large, the fourth pin pivot 74 crosses the link line of the second pin pivot 72 and the third pin pivot 73 to lock the connecting mechanism.

The wrench with translational wrench jaw provided by the present invention, is suitable for gripping various workpieces; adopting two-stage transmission can provide greater gripping forces and is more efficient. When the external forces are no longer applied to the handles of the wrench with translational wrench jaw, first under the action of the elastic force of the first elastic component, the first connecting rod rotates, which makes the fourth pin pivot move toward the connecting portion, removing the great gripping forces between the first wrench jaw and the second wrench jaw; in this case, the claw disengages from the teeth of the first flank, avoiding structural damage, thus prolonging the service life of the wrench with translational wrench jaw; the wrench with translational wrench jaw further comprises a locking mechanism for keeping the gripping status, and thus the operator's hands can be released to complete other operations under the gripping status.

The invention has been exemplified above with reference to specific embodiments. However, it should be understood that a multitude of modifications and varieties can be made by a common person skilled in the art based on the conception of the present invention. Therefore, any technical schemes, acquired by the person skilled in the art based on the conception of the present invention through logical analyses, deductions or limited experiments, fall within the scope of the invention as specified in the claims.

The invention claimed is:

1. A wrench with translational wrench jaw characterized by comprising:

a first wrench jaw, a first handle and a connecting portion connecting the first wrench jaw and the first handle, the connecting portion being arranged with a long hole, the long hole being provided with a first flank and a second flank which are parallel to each other, and the first flank being arranged with teeth;

a second handle, connected with the connecting portion via a claw arranged in the long hole, the second handle being connected with the claw via a first pin pivot, the first end of the second handle being arranged with a cam;

a second wrench jaw, connected with the connecting portion in a sliding manner, the second wrench jaw being arranged with a recess to accommodate the cam;

a first connecting rod, connected with the first handle via a second pin pivot, a first end of the first connecting rod being arranged with a first elastic component which is used for the restoration of the first connecting rod;

a second connecting rod, connected with the second handle via a third pin pivot, a first end of the second connecting rod being arranged with a second elastic component which is used for the restoration of the second connecting rod, the second end of the first connecting rod being connected with a second end of the second connecting rod via a fourth pin pivot;

wherein when a workpiece is placed between the first wrench jaw and the second wrench jaw, applying forces in opposite directions respectively to the first handle and the second handle makes the first handle and the second handle move toward each other; the second handle rotates around the first pin pivot, making the second wrench jaw translate toward the first wrench jaw until the translation of the second wrench jaw is limited by the workpiece; the second connecting rod drives the second handle to move toward the second wrench jaw in order that the claw engages with the teeth on the first flank; keeping on applying the forces in the opposite directions, the second handle rotates around the first pin pivot, produces gripping forces greater than the forces in the opposite directions, and transmits the gripping forces to the gripping face of the first wrench jaw and the gripping face of the second wrench jaw;

wherein the second elastic component is a torsion spring;

wherein the wrench with translational wrench jaw further comprises a locking mechanism for preventing the movement of the second wrench jaw away from the first wrench jaw; the locking mechanism comprises a third connecting rod and a first end of the second connecting rod, the first end of the second connecting rod being in fan shape and teeth being arranged on the edge of the fan shape; the first end of the third connecting rod is connected with the second handle via a fifth pin pivot, and a pushing button is arranged on the second end of the third connecting rod, teeth being arranged on the flank of the third connecting rod which faces the first end of the second connecting rod.

2. The wrench with translational wrench jaw according to claim 1, characterized in that the wrench with translational wrench jaw is made of plate.

3. The wrench with translational wrench jaw according to claim 2, characterized in that the material of the plate is steel or iron.

4. The wrench with translational wrench jaw according to claim 2, characterized in that the second wrench jaw is connected with the connecting portion in a sliding manner via a sliding block arranged in the long hole.

5. The wrench with translational wrench jaw according to claim 4, characterized in that the first edge of the connecting portion facing the second wrench jaw parallels to the first flank of the long hole of the connecting portion; the second wrench jaw has a groove, and a gap is arranged between the first edge and the groove to enable the groove to move along the first edge.

6. The wrench with translational wrench jaw according to claim 1, characterized in that the wrench with translational wrench jaw is made by forging process.

7. The wrench with translational wrench jaw according to claim 6, characterized in that a guide slot, which is parallel to the first flank of the long hole of the connecting portion, is arranged on the connecting portion; the second wrench jaw is provided with a groove, a long strip protrusion being arranged on the flank facing the connecting portion thereof; the long strip protrusion is embedded in the guide slot to form a sliding connection between the second wrench jaw and the connecting portion.

8. The wrench with translational wrench jaw according to claim 1, characterized in that the first elastic component is a tension spring.

9. The wrench with translational wrench jaw according to claim 8, characterized in that the first connecting rod is in straight shape, and a stop block is arranged on the first handle.

10. The wrench with translational wrench jaw according to claim 8, characterized in that the first connecting rod is in folded shape.

11. The wrench with translational wrench jaw according to claim 1, characterized in that a neck is arranged on the second handle.

12. The wrench with translational wrench jaw according to claim 1, characterized in that the locking mechanism comprises a third elastic component.

13. The wrench with translational wrench jaw according to claim 12, characterized in that the third elastic component is a torsion spring.

14. The wrench with translational wrench jaw according to claim 1, characterized in that a scale is arranged on the connecting portion for measuring the distance between the first wrench jaw and the second wrench jaw.

* * * * *